US008881922B2

(12) United States Patent
Schlies et al.

(10) Patent No.: US 8,881,922 B2
(45) Date of Patent: Nov. 11, 2014

(54) HOT FILL CONTAINER HAVING IMPROVED CRUSH RESISTANCE

(75) Inventors: Anthony J. Schlies, York, PA (US); Justin A. Howell, New Cumberland, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 13/328,788

(22) Filed: Dec. 16, 2011

(65) Prior Publication Data

US 2013/0153531 A1 Jun. 20, 2013

(51) Int. Cl.
*B65D 90/02* (2006.01)
*B65D 8/04* (2006.01)
*B65D 8/12* (2006.01)

(52) U.S. Cl.
USPC ..... 215/381; 215/382; 215/383; 220/675; 220/673; 220/669

(58) Field of Classification Search
CPC ..... B65D 90/02; B65D 90/021; B65D 1/0223
USPC ..... 215/381, 383, 384, 382; 220/675, 669, 220/670, 671, 672, 673
See application file for complete search history.

(56) References Cited

U.S. PATENT DOCUMENTS 3,923,178 A * 12/1975 Welker, III ..... 215/381
5,704,504 A 1/1998 Bueno
7,191,910 B2 * 3/2007 Deemer et al. ..... 215/381
7,198,165 B2 * 4/2007 Zhang ..... 215/381
7,416,090 B2 * 8/2008 Mooney et al. ..... 215/381
7,604,140 B2 10/2009 Pritchett, Jr. et al.
8,113,368 B2 * 2/2012 Oguchi et al. ..... 215/381
D662,824 S * 7/2012 Perez ..... D9/516
2006/0070976 A1 4/2006 Ungrady
2006/0157439 A1 * 7/2006 Howell ..... 215/384
2006/0289378 A1 12/2006 Zhang
2009/0261059 A1 * 10/2009 Pritchett, Jr. ..... 215/381
2010/0032405 A1 * 2/2010 Ozawa et al. ..... 215/383

FOREIGN PATENT DOCUMENTS

JP WO2006129449 A1 * 12/2006
WO 2006129449 A1 12/2006

* cited by examiner

*Primary Examiner* — Fenn Mathew
*Assistant Examiner* — Don M Anderson
(74) *Attorney, Agent, or Firm* — Baker Botts LLP

(57) ABSTRACT

A hot fill type plastic container includes a finish portion that defines an opening and a main body portion having a sidewall that defines a plurality of vacuum panels and a plurality of creased wall portions. Each of the creased wall portions is positioned between two adjacent vacuum panels. At least one of the creased wall portions has an axis of longitudinal orientation when viewed in side elevation that has a vertical component and a circumferential component. The creased wall portions further preferably are substantially non-curved when viewed in side elevation and also preferably have a compound curvature to increase stiffness.

32 Claims, 7 Drawing Sheets

HOT FILL CONTAINER HAVING IMPROVED CRUSH RESISTANCE

BACKGROUND OF THE INVENTION

1. Field of the Invention

This invention relates generally to the field of blow molded plastic containers, and more particularly to containers that are suitable for use with food or beverage products that are packaged using the hot fill process.

2. Description of the Related Technology

Many products that were previously packaged using glass containers are now being supplied in plastic containers, such as containers that are fabricated from polyesters such as polyethylene terephthalate (PET).

PET containers are lightweight, inexpensive, recyclable and can be economically manufactured in large quantities. PET therefore possesses excellent characteristics for containers, but PET resin is relatively expensive. Accordingly, a PET container design that reduces the amount of material that is used without sacrificing performance will provide a significant competitive advantage within the packaging industry.

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

PET containers are particularly common for use in packaging beverages such as juices using what is known in the industry as the hot-fill process. This involves filling the containers while the liquid product is at an elevated temperature, typically 68° C.-96° C. (155° F.-205° F.) and usually about 85° C. (185° F.) in order to sterilize the container at the time of filling. Containers that are designed to withstand the process are known as "hot fill" or "heat set" containers.

Hot fill containers must be designed to be strong enough in the areas outside of the vacuum panel regions so that the deformation that occurs as a result of the volumetric shrinkage of a product within the container is substantially limited to the portions of the container that are designed specifically to accommodate such shrinkage. In addition, since filled containers are often stacked on top of one another for transportation and distribution, the sidewall of such containers must be designed to have sufficient column strength in order to endure a predetermined minimum vertical load. It is important that such column strength not be degraded as the shape of the container changes as result of volumetric shrinkage within the container.

Moreover, a hot fill container must possess adequate hoop or circumferential strength in order to avoid excessive outward and inward bowing during changes of temperature and pressure, as well as to provide sufficient crush resistance when the container is gripped by a consumer.

There is significant price competition within the plastic packaging industry, and the cost of plastic resin is one of the main components of the price of hot fill containers. There is a fundamental tension between the strength requirements of such containers and the economic necessity to use as little plastic resin as possible in order to provide a functional container. In order to optimize column strength and hoop strength, a variety of different designs have been commercialized, using various features such as ribs and grooves that are defined within the sidewall of the container during the molding process.

One type of hot fill container that is disclosed in U.S. Pat. No. 7,604,140 to Pritchett et al. utilizes a plurality of vacuum panels that are arranged in a twisted or helical fashion about the periphery of the container. Such a helical vacuum panel configuration possesses certain advantages, because it provides inherent reinforcement in both the longitudinally and circumferential directions. In addition, such containers can be aesthetically pleasing to many consumers. However, such containers would be usable for more commercial packaging applications if they had improved crush resistance.

A need exists for an improved hot fill type container employing twisted or helical vacuum panels that exhibits superior crush resistance with respect to conventional containers of this type without requiring significant additional material.

SUMMARY OF THE INVENTION

Accordingly, it is an object of the invention to provide an improved hot fill type container employing twisted or helical vacuum panels that exhibits superior crush resistance with respect to conventional containers of this type without requiring significant additional material.

In order to achieve the above and other objects of the invention, a hot fill type plastic container according to a first aspect of the invention includes a finish portion that defines an opening and a main body portion having a sidewall that defines a plurality of vacuum panels and a plurality of creased wall portions. Each of the creased wall portions is positioned between two adjacent vacuum panels. At least one of the creased wall portions has an axis of longitudinal orientation when viewed in side elevation that has a vertical component and a circumferential component. The creased wall portions further preferably are substantially non-curved when viewed in side elevation.

A hot fill type plastic container according to a second aspect of the invention includes a finish portion that defines an opening and a main body portion having a sidewall that defines a plurality of vacuum panels and a plurality of creased wall portions. Each of the creased wall portions is positioned between two adjacent vacuum panels. At least one of the creased wall portions has an axis of longitudinal orientation when viewed in side elevation that has a vertical component and a circumferential component. The creased wall portions further preferably have a compound curvature to increase stiffness.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
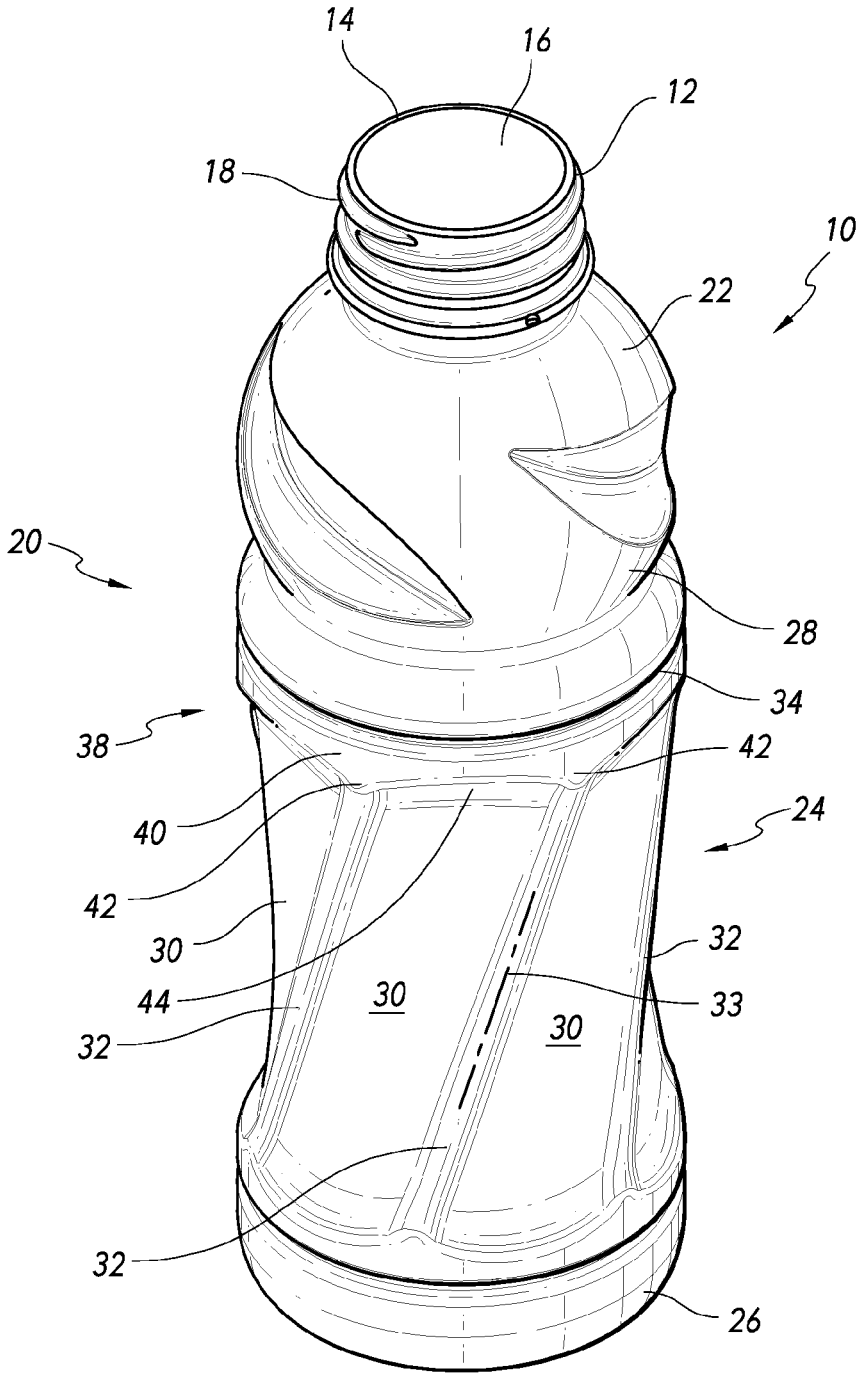
FIG. 1 is a perspective view of a container that is constructed according to a preferred embodiment of the invention.

Referring now to the drawings, wherein like reference numerals designate corresponding structure throughout the views, and referring in particular to FIG. 1, a hot fill type container 10 that is constructed according to a preferred embodiment of the invention is preferably fabricated from a plastic material such as polyethylene terephthalate using a conventional stretch reheat blow molding process.

Container 10 preferably includes a finish portion 12 having a rim 14 that defines an upper opening 16. A plurality of threads 18 may be defined on an outer surface of the finish portion 12 for securing a closure to the container 10.

Container 10 further includes a main body portion 20 having a sidewall 28 that defines an upper dome or shoulder portion 22 and a vacuum panel portion 24 that is constructed and arranged to deflect in response to internal volumetric changes during the hot fill process. Container 10 also includes a bottom portion 26 that is unitary with the vacuum panel portion 24, the dome portion 22 and the finish portion 12.

The vacuum panel portion 24 preferably includes a plurality of vacuum panels 30 and a corresponding plurality of creased wall portions 32 that are interposed between adjacent vacuum panels 30 about the periphery of the vacuum panel portion 24 of the main body portion 20. In other words, each of the creased wall portions 32 is preferably positioned between two adjacent vacuum panels 30. In the preferred embodiment, all of the creased wall portions 32 are preferably of substantially the same size and shape, and all of the vacuum panels 30 are also preferably substantially of the same size and shape.

Figure 2:
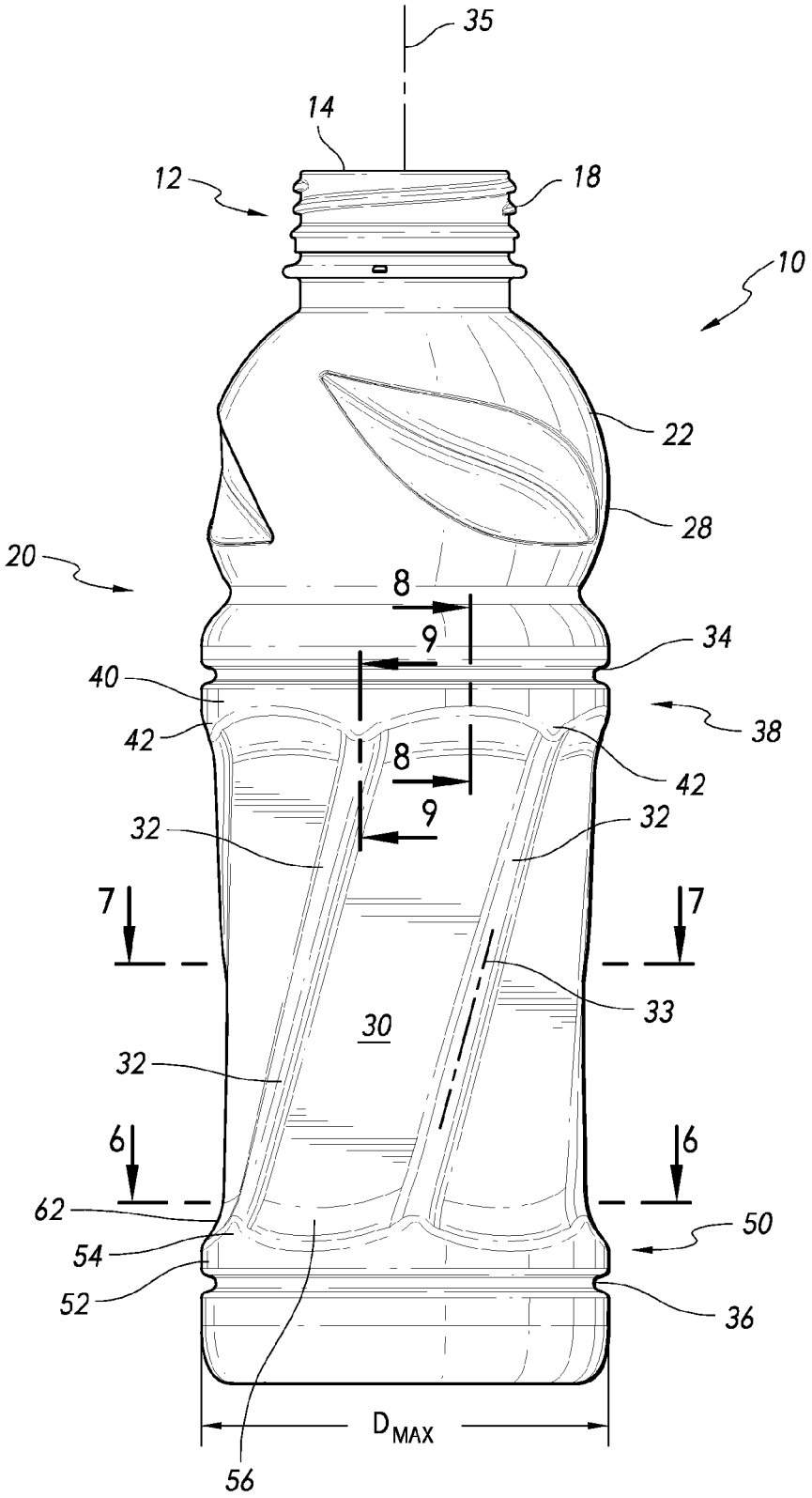
FIG. 2 is a front elevational view of the container that is shown in FIG. 1.

At least one of the creased wall portions 32 preferably has an axis 33 of longitudinal orientation when viewed in elevation, as shown in FIG. 2, that has both a vertical component and a circumferential component. In the illustrated embodiment, the axis 33 of longitudinal orientation is angled with respect to a longitudinal axis 35 of the container 10. The creased wall portions 32 and the vacuum panel portions 30 accordingly are disposed in a twisted or helical pattern throughout the vacuum panel portion 24. However, the at least one of the creased wall portions 32 is preferably shaped so as to be substantially non-curved when viewed in side elevation, as may be seen in FIGS. 2 and 3. In the preferred embodiment, all of the creased wall portions 32 are shaped so as to be substantially non-curved, and moreover preferably so that each is substantially linear.

Each of the creased wall portions 32 is preferably oriented so that it is substantially parallel to an adjacent creased wall portion 32.

The main body portion 20 further preferably includes a first circumferential groove 34 that is proximate to an upper end of the respective vacuum panels 30. The first circumferential groove 34 preferably is substantially circular in transverse cross-section, and is oriented within a plane that is substantially perpendicular to the longitudinal axis 35 of the container 10.

An upper transition portion 38 is defined between the upper end of the respective vacuum panels 30 and the first circumferential groove 34. The upper transition portion 38 preferably includes a first portion 40 that is substantially circular in transverse cross-section. The upper transition portion 38 also preferably includes a plurality of second tapered portions 42 connecting the first portion 40 to the respective creased wall portions 32, and a plurality of third tapered portions 44 connecting the first portion 42 to the respective vacuum panels 30.

Figure 9:
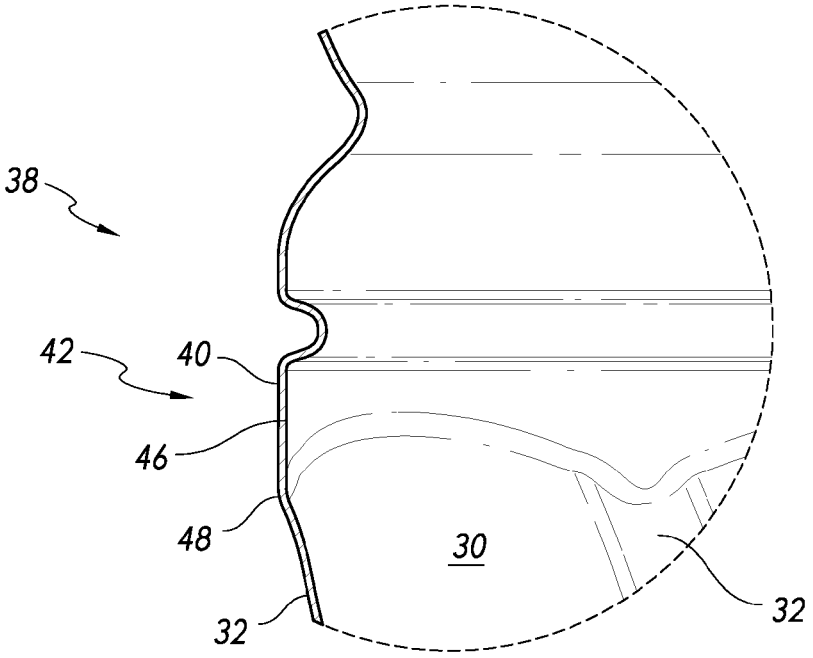
FIG. 9 is a cross-sectional view taken along lines 9-9 in FIG. 2.

Referring to FIG. 9, it will be seen that each of the second tapered portions 42 preferably includes an uppermost end 46 that is substantially circular in transverse cross-section and a convexly curved portion 48 that is positioned between the uppermost end 46 and the creased wall portion 32.

Figure 8:
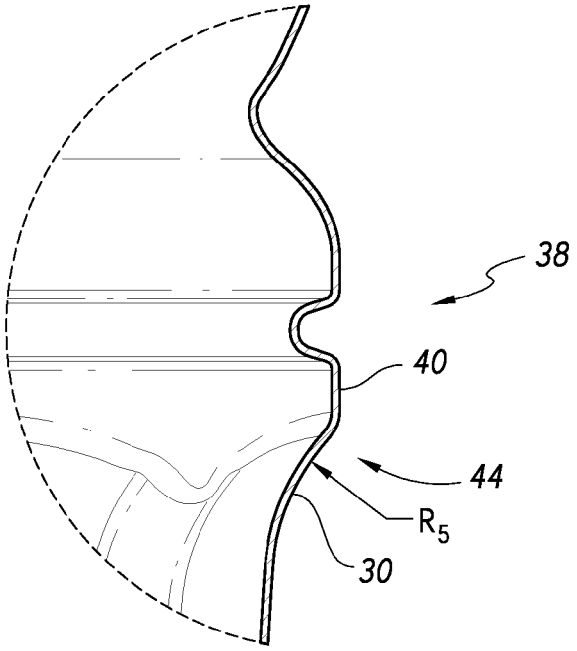
FIG. 8 is a cross-sectional view taken along lines 8-8 in FIG. 2.

As may be seen by comparing FIGS. 8 and 9, each of the third tapered portions 44 is preferably recessed with respect to the adjacent second tapered portion 42. Each of the third tapered portions 44 is moreover preferably substantially concave when viewed in side elevation, having an average radius of curvature $R_5$.

Figure 3:
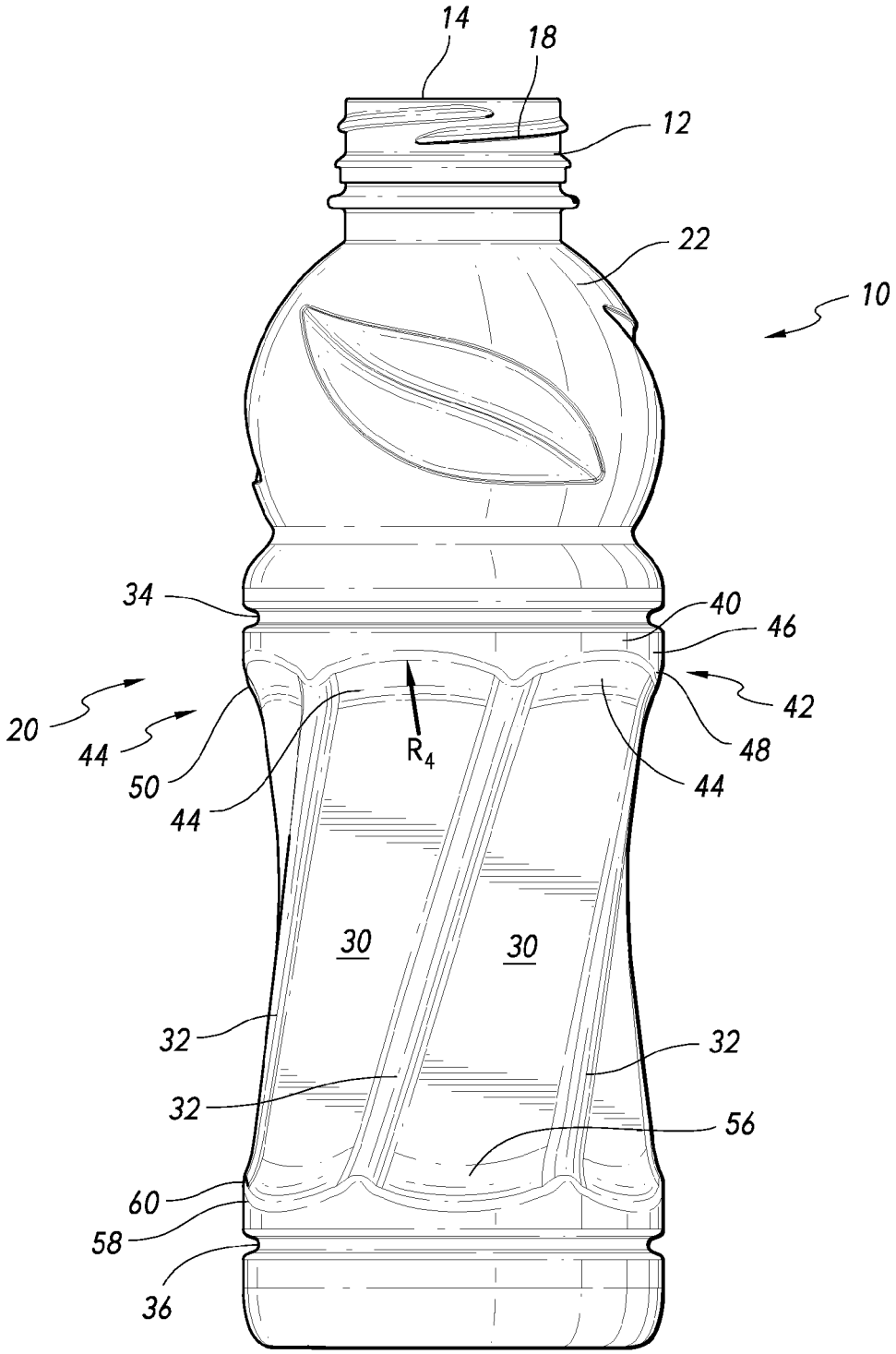
FIG. 3 is a side elevational view of the container that is shown in FIG. 1.
Figure 4:
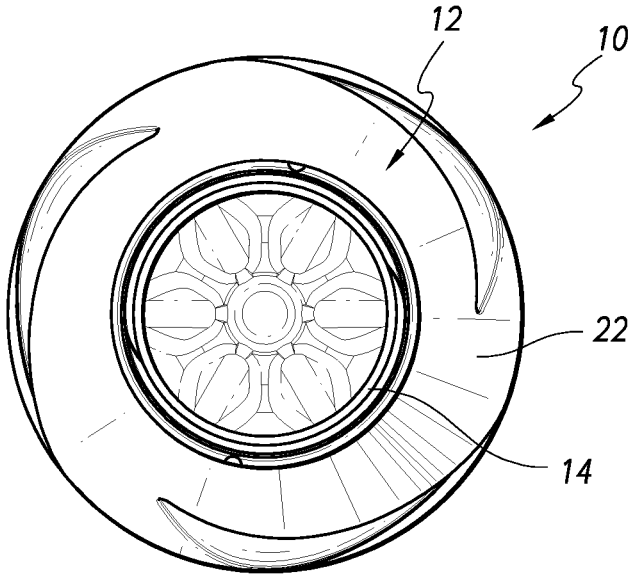
FIG. 4 is a top plan view of the container that is shown in FIG. 1.
Figure 5:
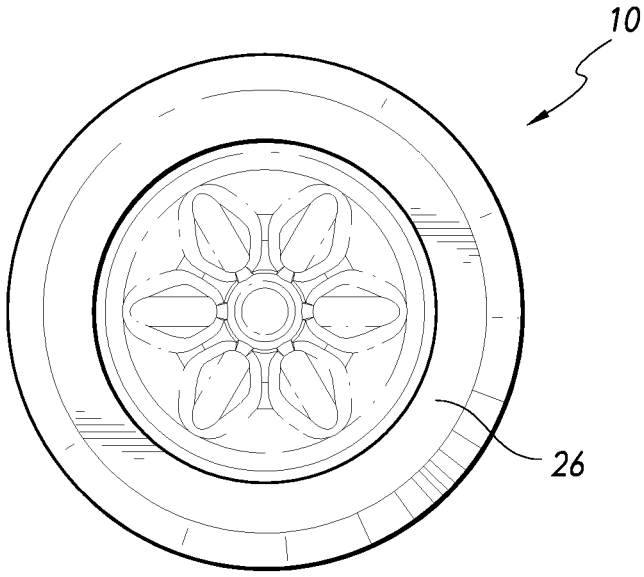
FIG. 5 is a bottom plan view of the container that is shown in FIG. 1.

As FIG. 2 shows, container 10 has a maximum outer diameter $D_{MAX}$. Preferably, at least one of the third tapered portions 44 has an average radius of curvature $R_4$ when viewed in side elevation, as is shown in FIG. 3. A ratio $R_4/D_{MAX}$ of the average radius of curvature $R_4$ to the maximum outer diameter $D_{MAX}$ is preferably substantially within a range of about 0.255 to about 0.8, more preferably substantially within a range of about 0.315 to about 0.720, and most preferably substantially within a range of about 0.395 to about 0.685.

Figure 10:
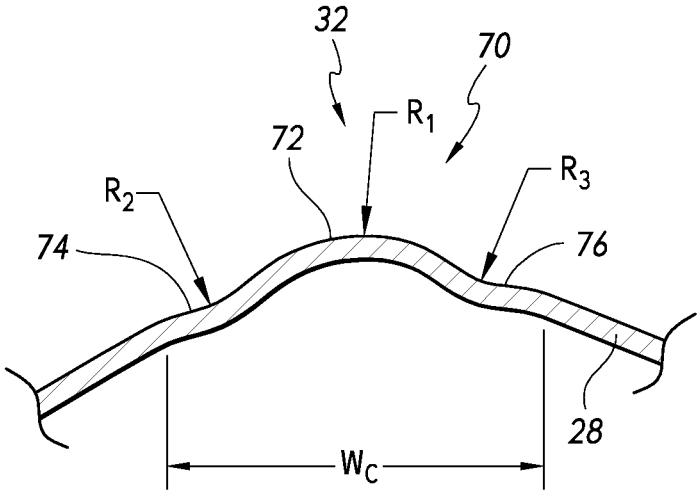
FIG. 10 is a fragmentary cross-sectional view showing one portion of the container that is depicted in FIG. 1.

As is best shown in FIG. 10, the creased wall portion 32 preferably has a compound curvature 70, which provides additional stiffening without significantly adding to material costs. In the preferred embodiment, the compound curvature 70 includes a convexly curved first central portion 72 having a first average radius of curvature $R_1$, a concavely curved second portion 74 positioned on a first side of the first central portion 72 and having a second average radius of curvature $R_2$ and a concavely curved third portion 76 position on a second side of the first central portion 72 and having a third average radius of curvature $R_3$. In the preferred embodiment, the second average radius of curvature $R_2$ is substantially the same as the third average radius of curvature $R_3$.

Preferably, a ratio $R_1/D_{MAX}$ of the first average radius of curvature $R_1$ to the maximum outer diameter $D_{MAX}$ of the container 10 is substantially within a range of about 0.01 to about 0.30, more preferably substantially within a range of about 0.03 to about 0.225 and most preferably substantially within a range of about 0.05 to about 0.150.

A ratio $R_2/D_{MAX}$ of the second average radius of curvature $R_2$ to the maximum outer diameter $D_{MAX}$ of the container 10 is preferably substantially within a range of about 0.01 to about 0.06, more preferably substantially within a range of about 0.02 to about 0.05, and most preferably substantially within a range of about 0.03 to about 0.04.

A ratio $R_2/R_1$ of the second average radius of curvature $R_2$ to the first average radius of curvature $R_1$ is preferably substantially within a range of about 0.27 to about 0.98, more preferably substantially within a range of about 0.35 to about 0.9 and most preferably substantially within a range of about 0.4 to about 0.8.

Figure 6:
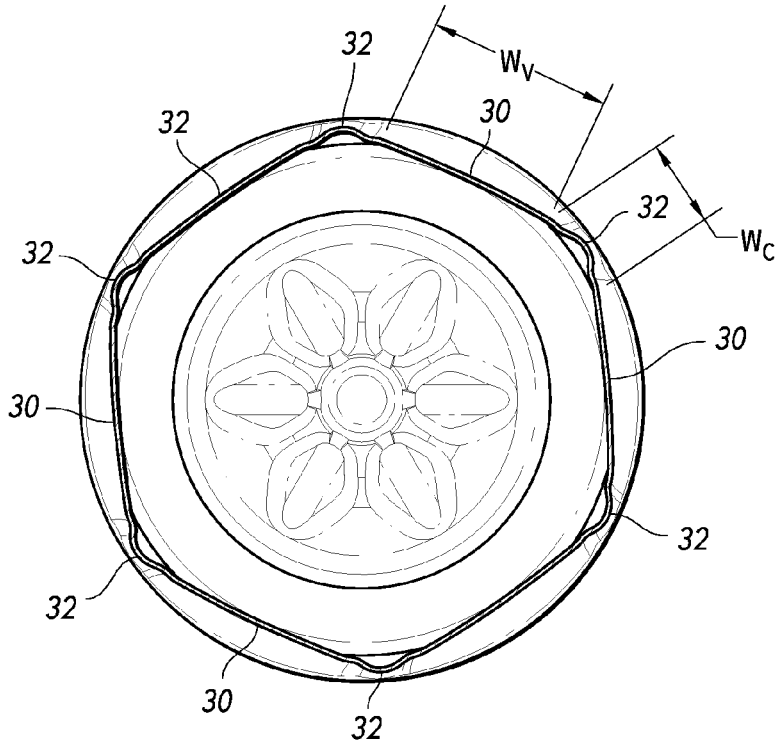
FIG. 6 is a cross-sectional view taken along lines 6-6 in FIG. 2.
Figure 7:
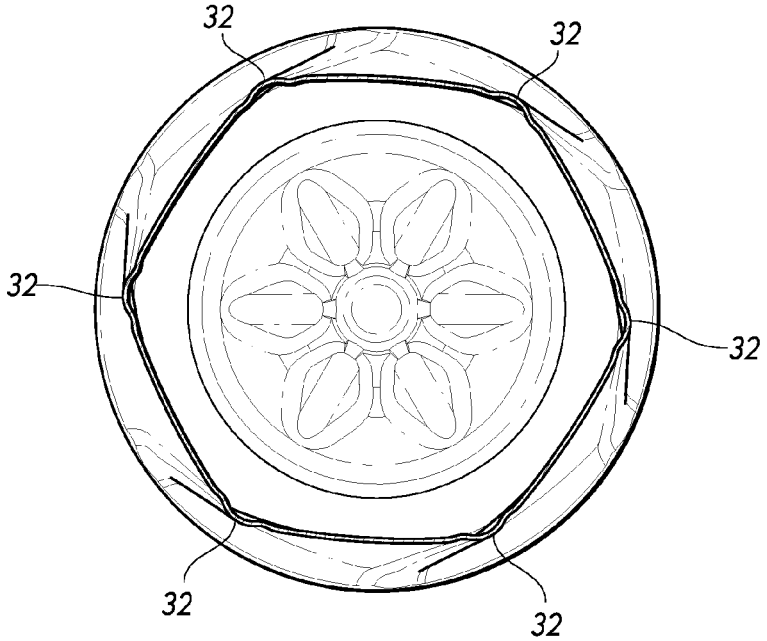
FIG. 7 is a cross-sectional view taken along lines 7-7 in FIG. 2.

Referring to FIG. 6, it will be seen that each of the vacuum panels 30 has a first width $W_V$ as viewed in transverse cross-section, and each of the creased wall portions 32 has a second width $W_C$ as viewed in the same cross-section. Preferably, a ratio $W_C/W_V$ of the second width $W_C$ to the first width $W_V$ is substantially within a range of about 0.32 to about 0.61, more preferably substantially within a range of about 0.37 to about 0.54 and most preferably substantially within a range of about 0.4 to about 0.5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hot fill type plastic container, comprising:

a finish portion defining an opening;

a shoulder portion;

a bottom portion; and a main body portion having a sidewall including an upper end portion and a lower end portion, the sidewall defining a plurality of vacuum panels and a plurality of straight creased wall portions, each of the vacuum panels being positioned between two adjacent straight creased wall portions, each straight creased wall portion having an axis of longitudinal orientation that has a vertical component and a circumferential component and being shaped so as to be substantially non-curved and linear when viewed in side elevation.

2. A hot fill type plastic container according to claim 1, wherein the main body portion further includes a first circumferential groove between the upper end portion and the shoulder portion.

3. A hot fill type plastic container according to claim 2, wherein the upper end portion comprises an upper transition portion extending between the upper end of the respective vacuum panels and the first circumferential groove, the upper transition portion comprising a first portion that is substantially circular in transverse cross-section, a plurality of second tapered portions connecting the first portion to the respective creased wall portions and a plurality of third tapered portions connecting the first portion to the respective vacuum panels.

4. A hot fill type plastic container according to claim 3, wherein each of the second tapered portions includes an uppermost end that is substantially circular in transverse cross-section and a convexly curved portion positioned between the uppermost end and the creased wall portion.

5. A hot fill type container according to claim 3, wherein each of the third tapered portions is recessed relative to the adjacent second tapered portions.

6. A hot fill type container according to claim 5, wherein each of the third tapered portions is downwardly concave when viewed in side elevation.

7. A hot fill type container according to claim 6, wherein the container has a maximum outer diameter, and at least one of the third tapered portions has an average radius of curvature when viewed in side elevation, and wherein a ratio of the average radius of curvature to the maximum diameter is substantially within a range of about 0.255 to about 0.8.

8. A hot fill type container according to claim 7, wherein the ratio of the average radius of curvature to the maximum diameter is substantially within a range of about 0.315 to about 0.720.

9. A hot fill type container according to claim 8, wherein the ratio of the average radius of curvature to the maximum diameter is substantially within a range of about 0.395 to about 0.685.

10. A hot fill type container according to claim 1, wherein the at least one creased wall portion has a compound curvature when viewed in transverse cross-section.

11. A hot fill type container according to claim 10, wherein the compound curvature comprises a convexly curved first central portion having a first average radius of curvature, a concavely curved second portion on a first side of the first central portion and having a second average radius of curvature and a concavely curved third portion positioned on a second side of the first central portion and having a third average radius of curvature.

12. A hot fill type container according to claim 11, wherein the second average radius of curvature is substantially the same as the third average radius of curvature.

13. A hot fill type container according to claim 11, wherein the container has a maximum outer diameter, and wherein a ratio of the first average radius of curvature to the maximum outer diameter is substantially within a range of about 0.01 to about 0.3.

14. A hot fill type container according to claim 13, wherein the ratio of the first average radius of curvature to the maximum outer diameter is substantially within a range of about 0.03 to about 0.225.

15. A hot fill type container according to claim 14, wherein the ratio of the first average radius of curvature to the maximum outer diameter is substantially within a range of about 0.05 to about 0.150.

16. A hot fill type container according to claim 11, wherein the container has a maximum outer diameter, and wherein a ratio of the second average radius of curvature to the maximum outer diameter is substantially within a range of about 0.01 to about 0.06.

17. A hot fill type container according to claim 16, wherein the ratio of the second average radius of curvature to the maximum outer diameter is substantially within a range of about 0.02 to about 0.05.

18. A hot fill type container according to claim 17, wherein the ratio of the second average radius of curvature to the maximum outer diameter is substantially within a range of about 0.03 to about 0.04.

19. A hot fill type container according to claim 1, wherein the vacuum panel has a first width as measured in transverse cross-section and an adjacent creased wall portion has a second width as measured in transverse cross-section, and wherein a ratio of the second width to the first width is substantially within a range of about 0.32 to about 0.61.

20. A hot fill type container according to claim 19, wherein the ratio of the second width to the first width is substantially within a range of about 0.37 to about 0.54.

21. A hot fill type container according to claim 20, wherein the ratio of the second width to the first width is substantially within a range of about 0.4 to about 0.5.

22. A hot fill type plastic container, comprising:

a finish portion defining an opening; and a main body portion having a sidewall including an upper end portion and a lower end portion, the sidewall defining a plurality of vacuum panels and a plurality of straight creased wall portions, each of the straight creased wall portions being positioned between two adjacent vacuum panels, each of the straight creased wall portions having an axis of longitudinal orientation that has a vertical component and a circumferential component and being shaped so as to be substantially non-curved and linear when viewed in side elevation, each straight creased wall portion having a compound curvature when viewed in transverse cross-section comprising a convexly curved first central portion having a first average radius of curvature, a concavely curved second portion positioned on a first side of the first central portion and having a second average radius of curvature and a concavely curved third portion positioned on a second side of the first central portion and having a third average radius of curvature.

23. A hot fill type container according to claim 22, wherein the second average radius of curvature is substantially the same as the third average radius of curvature.

24. A hot fill type container according to claim 22, wherein the container has a maximum outer diameter, and wherein a ratio of the first average radius of curvature to the maximum outer diameter is substantially within a range of about 0.01 to about 0.3.

25. A hot fill type container according to claim 24, wherein the ratio of the first average radius of curvature to the maximum outer diameter is substantially within a range of about 0.03 to about 0.225.

26. A hot fill type container according to claim 25, wherein the ratio of the first average radius of curvature to the maximum outer diameter is substantially within a range of about 0.05 to about 0.150.

27. A hot fill type container according to claim 22, wherein the container has a maximum outer diameter, and wherein a ratio of the second average radius of curvature to the maximum outer diameter is substantially within a range of about 0.01 to about 0.06.

28. A hot fill type container according to claim 27, wherein the ratio of the second average radius of curvature to the maximum outer diameter is substantially within a range of about 0.02 to about 0.05.

29. A hot fill type container according to claim 28, wherein the ratio of the second average radius of curvature to the maximum outer diameter is substantially within a range of about 0.03 to about 0.04.

30. A hot fill type container according to claim 22, wherein the vacuum panel has a first width as measured in transverse cross-section and an adjacent creased wall portion has a second width as measured in transverse cross-section, and wherein a ratio of the second width to the first width is substantially within a range of about 0.32 to about 0.61.

31. A hot fill type container according to claim 30, wherein the ratio of the second width to the first width is substantially within a range of about 0.37 to about 0.54.

32. A hot fill type container according to claim 31, wherein the ratio of the second width to the first width is substantially within a range of about 0.4 to about 0.5.

* * * * *